US005102297A

United States Patent [19]

Thompson

[11] Patent Number: 5,102,297

[45] Date of Patent: Apr. 7, 1992

[54] CENTRIFUGAL PUMP WITH CAVITATION REDUCING PROPELLER

[76] Inventor: George A. Thompson, 114 Demotte Ave., Daytona Beach, Fla. 32019

[21] Appl. No.: 564,476

[22] Filed: Aug. 8, 1990

[51] Int. Cl.[5] ..... F01D 25/24

[52] U.S. Cl. ..... 415/206; 415/56.2; 415/56.5; 416/223 B; 417/299

[58] Field of Search ..... 416/223 R, 223 B, 223 A; 415/206, 204, 56.1, 56.2, 56.5, 56.6, 203, 182.1, 146; 417/299

[56] References Cited

U.S. PATENT DOCUMENTS

| | | | |
|---|---|---|---|
| 1,382,665 | 6/1921 | Myers | 415/56.5 |
| 2,291,760 | 8/1942 | Rupp | 415/56.6 |
| 2,627,812 | 2/1953 | Mann | 415/56.6 |
| 2,994,275 | 8/1961 | Stepnica | 415/56.2 |
| 3,381,618 | 5/1968 | Napolitano | 415/146 |
| 3,425,436 | 2/1969 | Napolitano | 415/146 |
| 3,726,618 | 4/1973 | Dicmas | 415/56.5 |
| 3,856,429 | 12/1974 | Pettersson | 415/56.1 |
| 4,932,837 | 6/1990 | Rymal | 415/206 |

FOREIGN PATENT DOCUMENTS

| | | | |
|---|---|---|---|
| 0131347 | 1/1933 | Fed. Rep. of Germany | 416/223 R |
| 2155170 | 5/1973 | Fed. Rep. of Germany | 416/223 B |
| 0144695 | 8/1983 | Japan | 416/223 B |
| 0025548 | of 1899 | United Kingdom | 415/203 |
| 1534509 | 12/1978 | United Kingdom | 416/223 B |

*Primary Examiner*—Edward K. Look
*Assistant Examiner*—Christopher M. Verdier
*Attorney, Agent, or Firm*—Sughrue, Mion, Zinn, Macpeak & Seas

[57] ABSTRACT

A volute type centrifugal pump has an impeller rotatably mounted in a volute chamber of the pump casing adjacent a cutwater within the casing. The impeller includes a hub having a pair of diametrically extending vanes with the outer end portion of each vane being angled in a trailing direction relative to the direction of rotation of the impeller. A semi-cylindrical projection having an axis parallel to the axis of the hub is formed on a trailing surface of each angled portion adjacent an outermost end thereof thereby reducing cavitation on the trailing surface of the impeller to reduce drag and turbulence while increasing pressure on the trailing surface. The surface of the semi-cylindrical projection is roughened to enhance hydraulic jump.

1 Claim, 2 Drawing Sheets

FIG.3
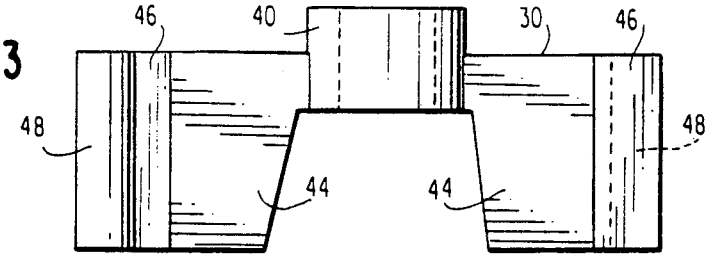
FIG.4
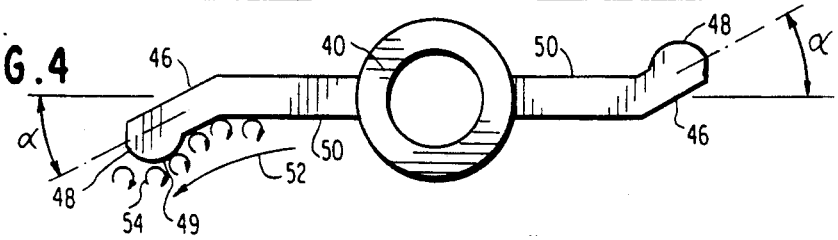
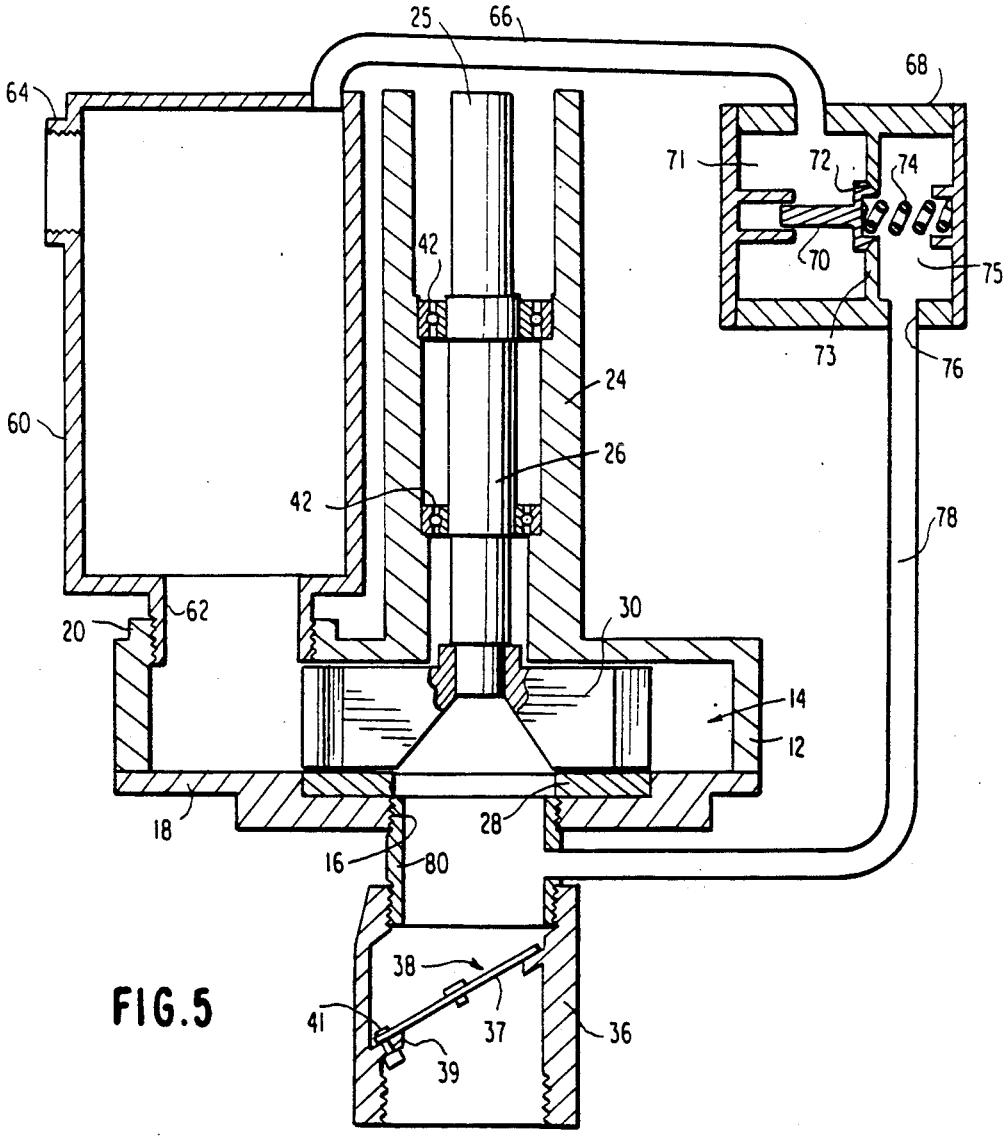
FIG.5

CENTRIFUGAL PUMP WITH CAVITATION REDUCING PROPELLER

BACKGROUND INFORMATION

The present invention is directed to a volute type centrifugal pump and more specifically to a volute pump having an impeller with two reversely angled Vanes each having a semi-cylindrical projection on the trailing surface adjacent the end thereof.

Volute type pumps are generally old and well known in the art wherein an impeller is rotatably driven within the volute by a motor for pumping fluid through the housing along a spiral flow path from an inlet concentric with the impeller to an enlarged outlet. If an impeller is used wherein a pair of oppositely extending straight, smooth impeller vanes are secured to a hub in a common plane, a considerable amount of cavitation will occur on the trailing surfaces of the vanes, thereby causing mechanical vibration and loss of efficiency. The separation of the fluid from the vanes at the cutwater also causes a substantial amount of turbulence which increases the drag on the impeller.

SUMMARY OF INVENTION

The present invention provides a new and improved volute type centrifugal pump which overcomes the aforementioned drawbacks of conventional volute pumps.

The present invention provides a new and improved volute type centrifugal pump comprising a casing having a volute chamber therein with an inlet and outlet, an impeller rotatably mounted in said chamber and means for rotating said impeller wherein said impeller is comprised of a hub having a pair of diametrically extending vanes with outer end portions angled in a trailing direction relative to the direction of rotation of said impeller and having a semi-cylindrical projection on the trailing surface of said angled portion adjacent an outermost end thereof, thereby reducing cavitation on the trailing surface of the impeller to reduce drag and turbulence while increasing pressure on the trailing surface.

The foregoing and other objects, features and advantages of the invention will be apparent from the following more particular description of a preferred embodiment of the invention as illustrated in the accompanying drawings.

BRIEF DESCRIPTION OF THE DRAWINGS

FIG. 3 is a side elevation view of the impeller according to the present invention.

FIG. 4 is a top plan view of the impeller according to the present invention.

FIG. 5 is a schematic view of the volute pump and priming arrangement for the pump.

DETAILED DESCRIPTION OF THE INVENTION

Figure 1:
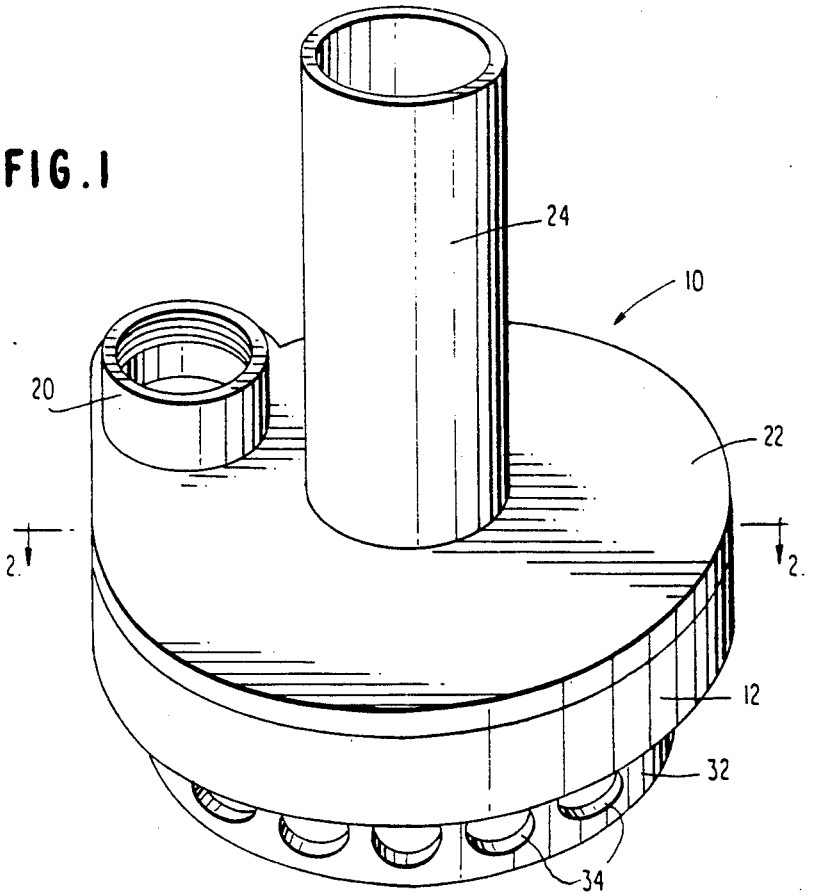
FIG. 1 is an external perspective view of the volute pump casing according to the present invention with an inlet strainer on the bottom thereof.
Figure 2:
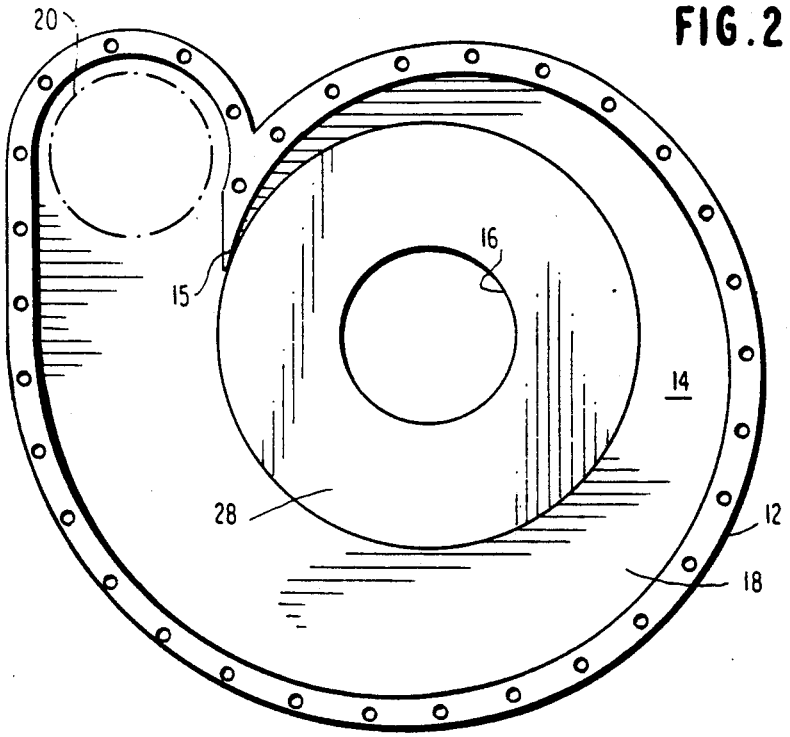
FIG. 2 is a cross-sectional view of the volute casing taken along the line II—II in FIG. 1.

The volute pump 10 according to the present invention is provided with a casing 12 having a volute chamber 14 therein with an inlet opening 16 in the bottom wall 18 and an outlet opening 20 extending through the upper wall 22 of the casing. A hollow cylindrical projection 24 extends upwardly from the upper surface. 22 of the casing 12 for receiving the drive shaft 26 for an impeller 30 which is disposed for rotation within the volute chamber 14. A wear plate 28 is disposed within a recess in the bottom Wall 18 of the casing opposite the impeller 30. The strainer basket 32 is secured to the bottom wall 18 of the casing and is provided with a plurality of apertures 34 to allow for the intake of fluid to the pump while preventing the entrance of large foreign objects which could damage the impeller. The pump, however, is designed to function as a submersible trash pump and is capable of handling solids up to a certain size. The strainer 32 is shown as connected directly to the bottom of the casing 12 in FIG. 1. In FIG. 5, the basket 32 would be secured to the lowermost end of the pipe section 36 having a check valve 38 located therein.

The check valve 38 is comprised of a flexible plate 37 extending transversely of the pipe section 36 and rests on an annular flange 39. The plate 37 is secured at one side by a rivet 41. Thus, fluid can flow into the pump past the check valve 38 but cannot flow in the opposite direction.

The impeller as shown in FIGS. 3–5 inclusive is comprised of a hub 40 which is adapted to be secured to the lowermost end of the shaft 26 which is mounted for rotation within the cylindrical support 24 by means of bearings 42. A pair of blades or vanes 44 extend outwardly from opposite sides of the hub 40 along a common diameter of the hub 40. The outermost end portion 46 of each blade 44 is bent in the trailing direction relative to the direction of rotation of the impeller at an angle Alpha which may be approximately 70°. The trailing surface of each angularly bent outer portion 46 is provided with a semi-cylindrical projection 48 having an axis substantially parallel to the axis of rotation of the hub 40. The action of a particle of fluid as it moves along the trailing surface 50 of each vane in the direction of the arrow 52 has motion imparted thereto as represented by the arrows 54 of FIG. 4 which are indicative of the hydraulic jump produced by the projection. In order to enhance the hydraulic jump or separation of the particles from the blade as it approaches the cutwater 15 in the chamber 14, the surface 49 of each projection 48 is roughened. Since the projection is formed as a single unitary casting from bronze or any other suitable material, the roughening of the surface 49 may be accomplished by sanding or grinding the surface with any suitable roughening tool. The provision of the semi-cylindrical projection having the roughened surface and the provision of the angled outer end portions of the blades in the trailing direction relative to the direction of rotation reduce cavitation and turbulence while increasing the pressure of the fluid on the trailing surface of each blade to reduce drag and increase the performance of the pump.

The outer end 25 of the shaft 26 is adapted to be connected to a flexible cable operating within a casing secured to the cylindrical support 24. The flexible cable may be driven by any suitable motor means at a remote location from the pump. Thus, the pump can be completely submersible without having to worry about enclosing the motor in a watertight casing. The volute centrifugal pump may be arranged as a self-priming pump as shown in FIG. 5 by the installation of a water recirculating tank 60 having an inlet portion 62 connected to the outlet portion 20 of the pump casing 12.

The main discharge flow of fluid will exit from the tank 60 through the outlet passage 64 while a return line 66 connects the tank 60 to a vacuum break valve 68. The vacuum break valve 68 is comprised of a movable valve member 70 in an inlet chamber 71 which is normally biased away from a valve seat 72 in a partition 73 by means of a spring 74 located in an outlet chamber 75. The outlet 78 of the vacuum break valve 68 is connected by means of a pipe 78 to an inlet pipe 80 secured between the bottom wall 18 of the volute pump and the pipe section 36 having check valve 38 therein. When the pump is not operating, the spring 74 will move the valve member 72 to the open position, thereby allowing fluid from the tank to flow through the pipe 66, the valve 68 and the pipe 78 to prime the pump. Once the pump is operating, the valve 70 will close against the force of the spring 74 so as to prevent the recirculation of fluid from the chamber to the inlet of the pump during the operation of the pump. As soon as the pump is stopped, valve 72 will again open to prime the pump for the next operation.

While the invention has been particularly shown and described with reference to a preferred embodiment thereof, it will be understood by those in the art that various changes in form and details may be made therein without departing from the spirit and scope of the invention.

What is claimed:

1. A volute type centrifugal pump for a liquid comprising a casing having a volute chamber therein with an inlet and outlet, an impeller rotatably mounted on said chamber and means for rotating said impeller in a direction of rotation to pump a liquid from said inlet to said outlet wherein said impeller is comprised of a hub having a pair of diametrically extending vanes each having an outer end portion angled in a trailing direction relative to the direction of rotation of said impeller and having a semi-cylindrical projection on a trailing surface of said angled portion adjacent an outermost end thereof.

* * * * *